US008641962B2

(12) United States Patent
Takahashi et al.

(10) Patent No.: US 8,641,962 B2
(45) Date of Patent: Feb. 4, 2014

(54) HIGHLY STIFF AND HIGHLY DAMPING CAST IRON

(75) Inventors: Sakae Takahashi, Mishima (JP); Naoki Sakamoto, Numazu (JP); Ryousuke Fujimoto, Numazu (JP); Ryousuke Ogawa, Numazu (JP); Yuji Nihei, Numazu (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 459 days.

(21) Appl. No.: 12/540,419

(22) Filed: Aug. 13, 2009

(65) Prior Publication Data

US 2009/0297386 A1 Dec. 3, 2009

Related U.S. Application Data

(63) Continuation of application No. PCT/JP2008/051410, filed on Jan. 30, 2008.

(30) Foreign Application Priority Data

Feb. 14, 2007 (JP) ..... 2007-033894
Dec. 18, 2007 (JP) ..... 2007-326447

(51) Int. Cl.
*C22C 37/10* (2006.01)

(52) U.S. Cl.
USPC ..... 420/28; 420/13; 420/33

(58) Field of Classification Search
USPC ..... 420/13, 28, 33; 148/321
See application file for complete search history.

(56) References Cited

U.S. PATENT DOCUMENTS

| | | | | |
|---|---|---|---|---|
| 4,244,754 | A * | 1/1981 | Masumoto et al. | 148/610 |
| 4,299,622 | A | 11/1981 | Kimira | |
| 4,548,643 | A * | 10/1985 | Betts | 420/17 |
| 2003/0116113 | A1 | 6/2003 | Ward | |
| 2004/0016530 | A1 | 1/2004 | Schoen | |

FOREIGN PATENT DOCUMENTS

| | | |
|---|---|---|
| DE | 2 132 417 | 1/1973 |
| DE | 2630141 | 2/1977 |
| JP | 51-133123 | 11/1976 |
| JP | 55-152149 | 11/1980 |
| JP | 63-140064 | 6/1988 |
| JP | 1-283341 | 11/1989 |
| JP | 9-78179 | 3/1997 |
| JP | 2001-200330 | 7/2001 |
| JP | 2002-348634 | 12/2002 |
| JP | 2005-513268 | 5/2005 |
| JP | 2008-223135 | 9/2008 |
| KR | 2001-0054925 | 7/2001 |

OTHER PUBLICATIONS

International Preliminary Report on Patentability (IPRP) issued in PCT/JP2008/051410 dated Aug. 19, 2009.

(Continued)

*Primary Examiner* — Deborah Yee
(74) *Attorney, Agent, or Firm* — DLA Piper LLP (US)

(57) ABSTRACT

A highly stiff and highly damping cast iron containing C and Si in an amount of 3.30 to 3.95% in terms of carbon equivalent shown in the following equation (1), Mn: 0.25 to 1.0%, P: 0.04% or less, S: 0.03% or less, Al: 3 to 7%, and Sn: 0.03 to 0.20%, balance being Fe and unavoidable impurities:

$$\text{Carbon equivalent (\%)} = C(\%) + (1/3) \times Si(\%) \quad (1).$$

2 Claims, 1 Drawing Sheet

(56) References Cited

OTHER PUBLICATIONS

International Preliminary Report on Patentability (IPRP) & Written Opinion issued in PCT/JP2008/051410 dated Aug. 19, 2009.
English Translation of International Preliminary Report on Patentability (IPRP) & Written Opinion issued in PCT/JP2008/051410 dated Aug. 19, 2009.
International Search Report issued in PCT/JP2009/058705 on Aug. 11, 2009.
English Language Translation of International Search Report issued in PCT/JP2009/058705 on Aug. 11, 2009.
Naoki Sakamoto et al., "Al o Tenka shita Henjo Kokuen Chutetsu no Young-ritsu to Taisu Gensuiritsu no Henka", Dai 150 Kai Zenkoku Koen Taikai Koen Gaiyoshu, May 1, 2007, p. 46.
Ryosuke Fujimoto et al., "Al o Tenka shita Henjo Kokuen Chutetsu no Young-ritsu to Taisu Gensuiritsu no Henka", Dai 150 Kai Zenkoku Koen Taikai Koen Gaiyoshu, May 1, 2007, p. 47.
Tsutomu Kurikuma et al., Effects of Graphite Morphology and Matrix Microstructure on Damping Capacity, Tensile Strength and Young's Modulus of Casting Irons, Chuzo Kogaku, 1996, vol. 68, No. 10, pp. 876-882.
Abstract of Tsutomu Kunkuma et al., Effects of Graphite Morphology and Matrix Microstructure on Damping Capacity, Tensile Strength and Young's Modulus of Casting Irons, Chuzo Kogaku, 1996, vol. 68, No. 10, pp. 876-882.
English Abstract of JP 1-283341 published Nov. 14, 1989.
English Abstract of JP 9-78179 published Mar. 25, 1997.
English Translation of JP 9-78179 published Mar. 25, 1997.
English Abstract of JP 2008-223135 published Sep. 25, 2008.
English Translation of JP 2008-223135 published Sep. 25, 2008.
German Office Action issued in DE 11 2008 000 392.0-24 on Nov. 25, 2010.
English Translation of German Office Action issued in DE 11 2008 000 392.0-24 on Nov. 25, 2010.
English Language Abstract of De 2132417 published Jan. 11, 1973.
Search Report of International Application No. PCT/JP2008/051410, May 13, 2008.
English language abstract of JP-51-133123, Nov. 18, 1976.
English language abstract of JP-55-152149, Nov. 27, 1980.
English language abstract of JP-63-140064, Jun. 11, 1988.
English language abstract of JP-2001-200330, Jul. 24, 2001.
Machine English language translation of JP-2001-200330, Jul. 24, 2001.
English language abstract of JP-2002-348634, Dec. 4, 2002
Machine English language translation of JP-2002-348634, Dec. 4, 2002.
English Language Abstract of JP 2005-513268 published on May 12, 2005.
English Language Translation of JP 2005-513268 published on May 12, 2005.
English Language Abstract of KR 2001-0054925 published Jul. 2, 2001.
English Language Abstract of DE 2630141 published on Feb. 3, 1977.
English Language Translation of International Preliminary Report on Patentability and Written Opinion issued in PCT/JP2009/058705 dated Feb. 1, 2011.
U.S. Appl. No. 14/015,760.
U.S. Appl. No. 12/940,140.

* cited by examiner

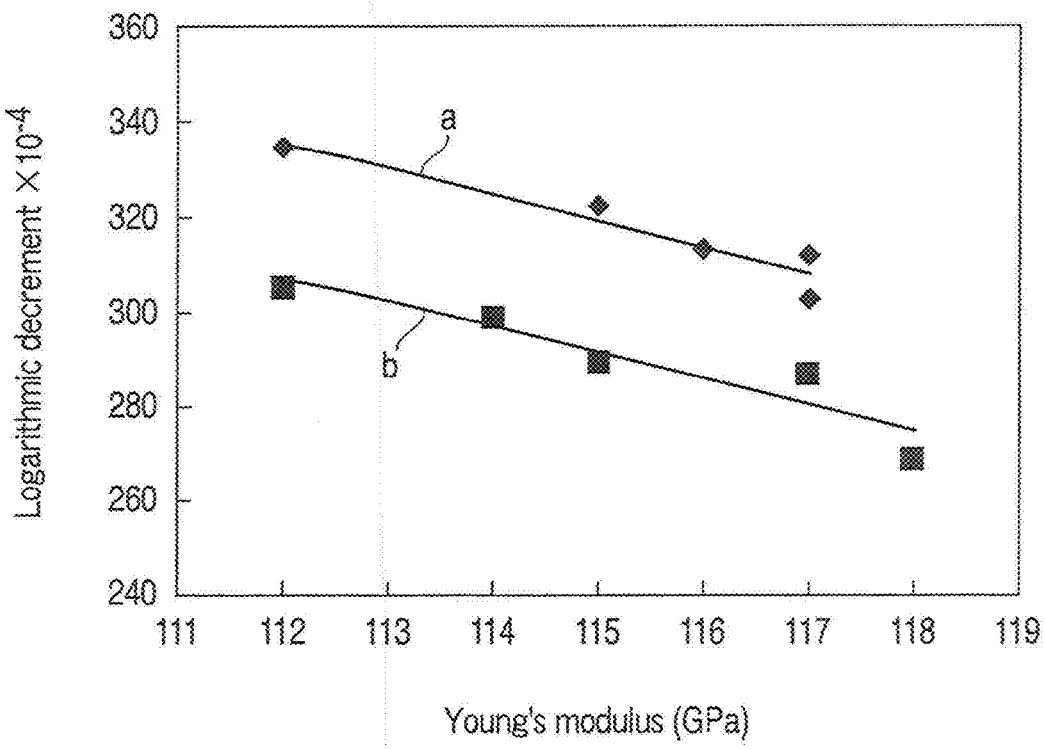
360
340
320
300
280
260
240
Logarithmic decrement ×10^-4
a
b
111
112
113
114
115
116
117
118
119
Young's modulus (GPa)

HIGHLY STIFF AND HIGHLY DAMPING CAST IRON

CROSS-REFERENCE TO RELATED APPLICATIONS

This is a Continuation Application of PCT Application No. PCT/JP2008/051410, filed Jan. 30, 2008, which was published under PCT Article 21(2) in Japanese.

This application is based upon and claims the benefit of priority from prior Japanese Patent Applications No. 2007-033894, filed Feb. 14, 2007; and No. 2007-326447, filed Dec. 18, 2007, the entire contents of both of which are incorporated herein by reference.

BACKGROUND OF THE INVENTION

1. Field of the Invention

The present invention relates to a highly stiff and highly damping cast iron superior in Young's modulus and vibration damping characteristics. When the cast iron of the present invention is used as, for example, structural materials of machine tools or high precision machine tools which need stiffness, or for structural materials of accurate-measuring instruments affected by problems concerning Young's modulus and vibration, the processing efficiency of these materials, accuracy of processed goods and degree of precision can be improved.

2. Description of the Related Art

Flake graphite cast iron which is relatively superior in vibration damping capability has been primarily used as structural materials of machine tools. Flake graphite cast iron has a combined type vibration-proof mechanism because it contains a large amount of flake graphite and therefore has higher damping capability than steel and the like. It also has the characteristics that it is advantageous in moldability and cost in the production of a large-scale structural material. In the meantime, studies have been made as to materials such as concrete type materials, natural granite and CFRP, each having high damping capability, in consideration of application of these materials to machine tool structural materials instead of using flake graphite cast iron. However, none of these materials has been put to practical use because each of these materials has problems concerning low stiffness, processability and costs.

Flake graphite cast iron superior in damping capability, casting capability and cost are widely used for structural materials such as beds, tables and columns of machine tolls. However, machine tools for the processing of materials hard to be processed need high stiffness enough to maintain deep cutting stably and high vibration damping capability to restrain the generation of harmful vibrations. In the case where further strict vibration damping capability is required in this manner, there is the case where the use of current flake graphite cast iron fails to obtain high processing efficiency and accuracy of processed goods because of the influence of vibration.

Because flake graphite cast iron such as FC300 which is currently used for machine tools and the like contains a lot of flake graphite which develops a combined type damping mechanism, it is a structural material superior in vibration damping capability among conventional materials. In order to improve the vibration damping capability of this flake graphite cast iron, it is only required to increase the amount of flake graphite. However, there is the problem that the dynamic Young's modulus (hereinafter referred to simply as "Young's modulus") decreases along with increase in the amount of flake graphite cast iron. The adjustment of the amount of flake graphite cast iron can be controlled by the amount of C and Si. As to the structural materials of machine tools, it is necessary to increase the wall thickness of the structural material to keep its stiffness if Young's modulus decreases. This causes not only a worsening of the problem of structural design but also an increase in cost, and is therefore undesirable.

As a method of improving the vibration damping capability, a method is proposed in which bainite or martensite is formed as the base organization of flake graphite cast iron (Casting Engineering 68 [1996], 876). However, in these methods, Young's modulus decreases as the vibration damping capability is improved, and it is therefore difficult to make the both compatible. Also, methods for improving the vibration damping capability are disclosed in Jpn. Pat. Appln. KOKAI Publication Nos. 63-140064 (Patent Document 1), 2001-200330 (Patent Document 2) and 2002-348634 (Patent Document 3). A method for improving the logarithmic decrement and the like are described in any of Patent Documents 1 to 3.

In these Patent Documents 1 to 3, the results of measurement of the vibration damping capability are shown. However, because nothing is found to show the descriptions of Young's modulus, its value is unclear. Specifically, it is suspected that Young's modulus is not essential but the strength is regarded as important because Patent Documents 1 and 2 relate to brake materials. In, particularly, Patent Document 1, there is the description that the object of the invention is to provide a brake material having high strength equal to that of gray cast iron and more excellent damping capability than gray cast iron. In Patent Document 3, there is the description that an aluminum-containing damping cast iron is invented to improve damping capability also with a view to improving the damping capability of machine tools and precision processing instruments. Although it is essentially necessary to keep the stiffness of the structural materials to keep the mechanical precision, this is not shown in these References.

It is found from these Patent Documents 1 to 3 that the vibration damping capability can be improved by adding aluminum. These methods, however, differ from each other when they are precisely examined. Specifically, Patent Document 1 describes that a material which is superior in vibration damping capability and has high strength is obtained by heat-treating cast iron to which aluminum is added. Patent Document 2 reveals that Al is added to cure and a hyper-eutectic composition is used to increase the amount of graphite and to form fine pores, thereby improving the vibration damping capability. However, Young's modulus decreases greatly in this method. Patent Document 3 shows an example in which aluminum is added to improve the vibration damping capability. However, there is no description concerning Young's modulus in Patent Document 3. Specifically, these methods described in Patent Documents 1 to 3 do not necessarily attain the compatibility between Young's modulus and vibration damping capability and it is therefore necessary to further improve the vibration damping capability.

BRIEF SUMMARY OF THE INVENTION

It is an object of the present invention to provide a highly stiff and highly damping cast iron which can be more improved in Young's modulus and vibration damping capability while making compatible Young's modulus and the vibration damping capability.

In order to achieve the above object, a highly stiff and highly damping cast iron (first aspect) according to the present invention comprises C and Si in an amount of 3.30 to 3.95% in terms of carbon equivalent shown in the following equation (1), Mn: 0.25 to 1.0%, P: 0.04% or less, S: 0.03% or less, Al: 3 to 7%, and Sn: 0.03 to 0.20%, balance being Fe and unavoidable impurities:

$$\text{Carbon equivalent [\%]} = \text{C [\%]} + (1/3) \times \text{Si [\%]} \quad (1)$$

Also, a highly stiff and highly damping cast iron (second aspect) according to the present invention comprises C and Si in an amount of 3.30 to 3.95% in terms of the carbon equivalent shown in Equation 1, above, Mn: 0.05 to 0.65%, P: 0.04% or less, S: 0.03% or less, Al: 3 to 7%, and Sn: 0.03 to 0.20%, balance being Fe and unavoidable impurities.

According to the present invention, a highly stiff and highly damping cast iron is obtained which is superior in Young's modulus and vibration damping characteristics enough to more improve the vibration damping capability while making compatible Young's modulus and the vibration damping capability. Specifically, a highly stiff and highly damping cast iron is obtained which has the same level of Young's modulus as the flake graphite cast iron currently used and superior in vibration damping capability, and is very superior in vibration damping capability.

BRIEF DESCRIPTION OF THE SEVERAL VIEWS OF THE DRAWING

The single FIGURE is a characteristic view showing the relationship between logarithmic decrement ($\times 10^{-4}$) and Young's modulus (GPa) in the case where the amount of Mn is controlled to be small or the amount of Mn is not controlled to be small.

DETAILED DESCRIPTION OF THE INVENTION

The present invention will be explained in more detail.

Flake graphite cast iron is more improved in vibration damping capability with increase in the amount of aluminum (Al) with the presence of a limit to the improvement. When, for example, the amount of Al to be added is gradually increased to measure the vibration damping capability and Young's modulus of the cast iron, an improvement in these characteristics is observed when the amount of Al is 3% or more, but when the amount exceeds 7%, the vibration damping capability is somewhat reduced. However, the inventors of the present invention have eventually found that Young's modulus and the vibration damping capability are improved by adding tin (Sn) in an appropriate amount to the flake graphite cast iron to which Al is added. The inventors of the present invention have also clarified that the vibration damping capability and Young's modulus are greatly varied by controlling the carbon equivalent (C.E.), (C/Si) ratio by weight of the flake graphite cast iron and the amounts of Al and Sn to be added. In order to improve the vibration damping capability while maintaining Young's modulus, it is necessary to adjust proper values of C.E., (C/Si) ratio by weight, and amounts of Al and Sn which are defined in the claims.

The reason why the amount of Al is designed to be a value of 3 to 7% is as follows. Specifically, when Al is added in an amount of 3% or more, this has a desired influence on the vibration damping capability of the flake graphite cast iron to which Al and Sn are added. If the amount of Al is less than 3%, there is almost no improvement. Also, if the amount of Al is 6% or more, the vibration damping capability gradually decreases and if the amount of Al exceeds 7%, the vibration damping capability further decreases. Then, if the amount of Al to be added exceeds 7%, an iron-Al carbide formed by the addition of Al is hard and fragile, so that it is easily broken and also, the processability is impaired. This is why the proper amount of Al to be added is designed to be 3 to 7%.

With regard to the mechanism for improving the vibration damping capability of flake graphite cast iron, there are the opinion (former) based on the formation of an iron alloy with Al contained as a solid solution and the opinion (latter) based on the formation of an iron-Al carbide. The inventors of the present invention have gotten the grasp on the latter opinion through the studies made by the inventors. Both of the opinions are the same in the point that it is inferred that they are based on the ferromagnetic damping mechanism of these formed materials.

The reason why the amount of Sn is designed to be a value of 0.03 to 0.2% is as follows. Specifically, when the amount of Sn to be added is too small, the effects of improving Young's modulus and vibration damping capability are not observed. These effects start to appear when the amount of Sn is about 0.03% and are most significantly observed when the amount of Sn is around 0.08%. When the amount of Sn is more increased, the effects are gradually decreased and when the amount of Sn is 0.2% or more, the effects are greatly reduced, with the result that no improving effect is obtained. Therefore, the proper amount of Sn is 0.03 to 0.2%. Sn is an element having an effect of improving Young's modulus and vibration damping capability.

The mechanism of the effect of improving by the addition of Sn is considered to be as follows, though there are many opinions about the mechanism. Specifically, it is said that when Al is added to flake graphite cast iron, an iron-Al carbide is formed by the reaction among iron, Al and carbon. Also, the iron-Al carbide is a ferromagnetic material and it is said that the iron-Al carbide develops a ferromagnetic-type vibration damping mechanism. According to the studies by the present inventors, the amount of the iron-Al carbide is increased when the amount of Al to be added is increased, and when the amount of Al is about 6%, an increase in the amount of the iron-Al carbide is stopped. However, when Sn is added, the iron-Al carbide is always formed in a more amount than in the case of singly adding Al, with the result that the improving effect due to the addition of Sn is produced.

In the present invention, the highly stiff and highly damping cast iron according to the present invention contains C, Si, Mn, P, S and the like besides the above Al and Sn. Here, the amounts of C and Si will be mentioned in detail later.

The amount of Mn is designed to be 0.25 to 1.0% similarly to the case of usual flake graphite cast iron. This is because, when the amount of Mn is 0.25% or more, the cast iron is improved in strength and hardness whereas when the amount of Mn exceeds 1.0%, the cast iron is chilled and the resulting cast iron is hardened and is fragile. Therefore, the amount is designed to be in the above range.

Also, in the second invention, the amount of manganese (Mn) is designed to be 0.05 to 0.65%. This reason is as follows. Specifically, when the amount of Mn exceeds 0.65%, the vibration characteristics are degraded and therefore, the amount of Mn in the cast iron composition is designed to be 0.65% or less. As the amount of Mn is reduced, the vibration characteristics are more improved. However, a small amount of Mn is originally contained in a cast iron raw material and it is economically disadvantageous to reduce the amount of Mn more than required. Accordingly, the lower limit of the amount of Mn is designed to be 0.05%. The reason why the vibration damping capability is reduced when the amount of Mn exceeds 0.65% has not been clarified yet.

The amount of P is designed to be 0.04% or less similarly to the case of usual flake graphite cast iron. This is because, when P exceeds 0.04%, it reacts with iron to form steadite which is a hard compound and makes cast iron fragile and therefore, the amount of P is designed to be in the above range.

The amount of S is designed to be 0.03% or less similarly to the case of usual flake graphite cast iron. This is because, when S exceeds 0.03%, the fluidity of the molten bath is reduced and also, the resulting cast iron is chilled so that it is hardened and is made fragile.

In the present invention, the carbon equivalent shown in Equation 1, above, is preferably designed to be 3.30 to 3.95%. When the carbon equivalent is increased, the vibration damping capability is improved, and Young's modulus is reduced. Although the vibration damping capability and Young's modulus cannot be made to be compatible by increasing or decreasing the carbon equivalent, the carbon equivalent has a large influence on the vibration damping capability and Young's modulus and it is therefore necessary to design a proper value as the carbon equivalent. When Al is added, an eutectic composition enabling an increase in an eutectic reaction between austenite and graphite is changed as compared with the case of a usual flake graphite cast iron. Although the usual flak graphite cast iron undergoes an eutectic reaction when the carbon equivalent given by Equation 1, above, is 4.3%, the addition of Al allows the eutectic reaction to run when the carbon equivalent is less than the above value. When the carbon equivalent is larger than that of the eutectic composition, this brings about a hyper-eutectic state, resulting in a greatly decreased Young's modulus, and therefore, a carbon equivalent out of the above range is undesirable.

When the carbon equivalent (C.E.) exceeds 3.95%, in the case of the present invention, the vibration damping capability is greatly improved but Young's modulus is greatly reduced. This is considered to be because the carbon equivalent exceeds that of the eutectic composition, bringing about a super-eutectic state. When the carbon equivalent is small, the amount of graphite to be formed is reduced and therefore, Young's modulus is improved but the vibration damping capability is reduced. Therefore, a carbon equivalent of 3.3% or more is necessary. Accordingly, the carbon equivalent is preferably 3.30 to 3.90.

In this case, the ratio by weight of C to Si (C/Si) is preferably 1.3 to 1.9 and more preferably 1.4 to 1.8. This is because, when the ratio by weight of C/Si is less than 1.3 or exceeds 1.9, the logarithmic decrement is greatly reduced.

Next, specific examples of the present invention will be explained together with comparative examples.

EXAMPLES 1 TO 5 AND COMPARATIVE EXAMPLES 1 TO 11

First, a composition of cast iron was adjusted by using a high-frequency melting furnace. Then, a cast iron lump made of FC300, a carbonizing material, ferromanganese, and silicon carbide were put in a graphite crucible and melted. Then, the amounts of carbon and silicon were adjusted by using ferrosilicone and carbonizing material such that the dissolution amount was about 20 kg. The amount of Al in a casting product to be obtained was adjusted by adding ferroaluminum and the amount of tin was adjusted by adding pure tin. Also, the dissolution temperature was designed to be about 1450° C. A Ca—Si—Ba type inoculation agent was added before a molten bath was discharged, and then the molten bath was cast using a furan self-hardening mold having a size of ϕ30×300 mm.

The obtained cast product was processed into a size of 4×20×200 mm to find the logarithmic decrement and dynamic Young's modulus as the values for evaluating the vibration damping capability. The test method accorded to JISG0602. Specifically, a test specimen was suspended by two points to give a strain amplitude of $1\times10^{-4}$ to the test specimen by an electromagnetic exciter and then, the exciter was stopped to allow the test specimen to damp freely, thereby finding the logarithmic decrement and dynamic Young's modulus. The characteristics of the cast product obtained in this manner are shown in the following Table 1. In this case, the logarithmic decrement indicates a value when the strain amplitude of vibration is $1\times10^{-4}$.

TABLE 1

| | C | Si | Mn | P | S | Al | Sn | C.E. % | Hardness HB | Dynamic Young's modulus GPa | Logarithmic decrement $\times10^{-4}$ |
|---|---|---|---|---|---|---|---|---|---|---|---|
| Comparative Example 1 | 3.42 | 1.66 | 0.78 | 0.026 | 0.010 | 5.23 | 0.087 | 3.97 | 201 | 78 | 661 |
| Example 1 | 3.19 | 2.06 | 0.76 | 0.026 | 0.020 | 5.12 | 0.033 | 3.88 | 217 | 111 | 303 |
| Example 2 | 3.22 | 2.10 | 0.76 | 0.026 | 0.013 | 3.04 | 0.110 | 3.92 | 232 | 118 | 211 |
| Comparative Example 2 | 3.21 | 1.95 | 0.76 | 0.025 | 0.015 | 3.08 | — | 3.86 | 136 | 100 | 191 |
| Example 3 | 3.18 | 2.00 | 0.76 | 0.022 | 0.007 | 5.09 | 0.051 | 3.85 | 225 | 112 | 346 |
| Comparative Example 3 | 3.22 | 2.08 | 0.76 | 0.024 | 0.012 | 5.04 | — | 3.91 | 215 | 100 | 282 |
| Example 4 | 3.12 | 2.16 | 0.78 | 0.027 | 0.007 | 6.14 | 0.068 | 3.84 | 240 | 107 | 504 |
| Comparative Example 4 | 3.04 | 2.08 | 0.77 | 0.022 | 0.007 | 6.08 | — | 3.73 | 239 | 107 | 421 |
| Example 5 | 2.94 | 1.84 | 0.76 | 0.024 | 0.010 | 6.92 | 0.181 | 3.55 | 295 | 128 | 282 |
| Comparative Example 5 | 2.91 | 1.86 | 0.80 | 0.014 | 0.003 | 6.94 | — | 3.53 | 302 | 127 | 239 |
| Comparative Example 6 | 3.04 | 1.98 | 0.76 | 0.022 | 0.009 | 7.72 | 0.071 | 3.70 | 368 | 129 | 236 |
| Comparative Example 7 | 2.70 | 1.74 | 0.79 | 0.022 | 0.009 | 5.11 | 0.096 | 3.28 | 275 | 143 | 96 |
| Comparative Example 8 | 3.32 | 1.80 | 0.93 | 0.023 | 0.015 | — | — | — | 208 | 133 | 79 |
| Comparative Example 9 | 3.45 | 1.83 | 0.75 | 0.024 | 0.022 | — | — | — | 212 | 126 | 105 |
| Comparative Example 10 | 3.56 | 1.89 | 0.98 | 0.023 | 0.016 | — | — | — | 185 | 121 | 119 |
| Comparative Example 11 | 3.66 | 1.94 | 0.92 | 0.024 | 0.021 | — | — | — | 147 | 102 | 222 |

The following facts are clear from the above Table 1. Examples 2, 3, 4 and 5 in which Al and Sn are added at the same time are superior in the values of Young's modulus and logarithmic decrement to Comparative Examples 2, 3, 4 and 5 in which Al is singly added. Because the characteristics of a cast product are greatly varied by the amount of Al to be added and carbon equivalent, more excellent characteristics can be obtained in the case of adding Al and Sn at the same time from comparisons between Example 2 and Comparative Example 2, between Example 3 and Comparative Example 3, between Example 4 and Comparative Example 4 and between Example 5 and Comparative Example 5 which have almost the same condition as to these factors.

Comparative Example 1 is a cast product in which Al and Sn are added at the same time. However, because it has a high carbon equivalent, it has a high logarithmic decrement, but it is greatly reduced in Young's modulus, making it difficult to maintain Young's modulus (specifically, 100 GPa) required for machine tools and the like. Therefore, this cast product cannot be used for structural members requiring stiffness. Example 1 is an example in which the amount of Sn to be added is small, and is more reduced in the effect of improving the logarithmic decrement than Example 3 having the same carbon equivalent and the same amount of Al. In this case, though not described in Table 1, when the amount of Sn to be added is less than 0.03%, almost no effect obtained by addition of Sn is obtained.

Comparative Example 6 is an example in which Al exceeds 7%. When the amount of Al to be added is increased, a cast product is hardened and is degraded in processability, so that it cannot be used actually. Comparative Example 7 is an example in which the carbon equivalent is too low, and is therefore greatly reduced in logarithmic decrement, which is undesirable. Comparative Examples 8, 9, 10 and 11 are examples of conventional flake graphite cast irons. Comparison between Examples and these Comparative Examples reveals that any of the cast products obtained in Examples has a higher logarithmic decrement than each of these comparative flake graphite cast irons if Young's modulus is the same.

In the above Table 1, Comparative Example 1 has a lower Young's modulus (E) since C.E. is low. Example 1 is an example in which Sn is reduced to the lower limit. In Comparative Example 6, the cast iron is hard when the amount of Al is large. In Comparative Example 7, C.E. is too small.

As mentioned above, the flake graphite cast iron in which Al and Sn are added at the same time shows that cast iron can be obtained which is more improved in logarithmic decrement than conventional flake graphite cast irons and flake graphite cast irons in which Al is only added, provided that Young's modulus is the same. Also, the flake graphite cast iron in which Al and Sn are added at the same time can exhibit higher vibration damping capability than conventional cast irons while maintaining Young's modulus (specifically, 100 GPa) required for machine tools and the like.

EXAMPLES 6 TO 10 AND COMPARATIVE EXAMPLE 12 TO 16

First, a composition of cast iron was adjusted by using a high-frequency melting furnace. Then, a cast iron lump made of FC300, a carbonizing material, ferromanganese, and silicon carbide were put in a graphite crucible and melted. Then, the amounts of carbon and silicon were adjusted by using ferrosilicone and carbonizing material such that the dissolution amount was about 250 kg. The amount of Al in a cast product to be obtained was adjusted by adding ferroaluminum and the amount of tin was adjusted by adding pure tin. Also, the dissolution temperature was designed to be about 1500° C. A Ca—Si—Ba type inoculation agent was added before a molten bath was discharged, and then the molten bath was cast using a furan self-hardening mold having a size of ϕ30×300 mm.

The obtained cast product was processed into a size of 4×20×200 mm to find the logarithmic decrement and dynamic Young's modulus as the values for evaluating the vibration damping capability. The test method accorded to JISG0602. Specifically, a test specimen was suspended by two points to give a strain amplitude of $1\times10^{-4}$ to the test specimen by an electromagnetic exciter and then, the exciter was stopped to allow the test specimen to damp freely, thereby finding the logarithmic decrement and dynamic Young's modulus. The characteristics of the cast product obtained in this manner are shown in the following Table 2. In this case, the logarithmic decrement indicates a value when the strain amplitude of vibration is $1\times10^{-4}$.

TABLE 2

| | C | Si | Mn | P | S | Al | Sn | C.E. % | Hardness HB | Dynamic Young's modulus GPa | Logarithmic decrement $\times10^{-4}$ |
|---|---|---|---|---|---|---|---|---|---|---|---|
| Example 6 | 3.02 | 1.84 | 0.32 | 0.020 | 0.003 | 5.94 | 0.069 | 3.63 | 256 | 115 | 323 |
| Example 7 | 2.99 | 1.80 | 0.32 | 0.022 | 0.006 | 5.93 | 0.073 | 3.59 | 252 | 117 | 313 |
| Example 8 | 3.01 | 1.84 | 0.13 | 0.019 | 0.008 | 5.84 | 0.074 | 3.62 | 248 | 112 | 335 |
| Example 9 | 3.08 | 1.90 | 0.50 | 0.021 | 0.010 | 6.04 | 0.073 | 3.71 | 253 | 116 | 314 |
| Example 10 | 3.01 | 1.86 | 0.64 | 0.021 | 0.003 | 6.06 | 0.070 | 3.63 | 255 | 117 | 304 |
| Comparative Example 12 | 3.03 | 1.94 | 0.68 | 0.021 | 0.004 | 5.78 | 0.069 | 3.68 | 262 | 117 | 288 |
| Comparative Example 13 | 3.00 | 1.88 | 0.81 | 0.020 | 0.006 | 6.00 | 0.072 | 3.63 | 262 | 118 | 270 |
| Comparative Example 14 | 3.08 | 1.98 | 0.77 | 0.022 | 0.007 | 6.17 | 0.074 | 3.74 | 257 | 115 | 290 |
| Comparative Example 15 | 3.07 | 2.09 | 0.77 | 0.020 | 0.007 | 6.07 | 0.076 | 3.75 | 255 | 114 | 300 |
| Comparative Example 16 | 2.99 | 1.85 | 0.92 | 0.022 | 0.006 | 6.01 | 0.077 | 3.61 | 260 | 260 | 306 |

FIG. 1 is a characteristic curve showing the relationship between the logarithmic decrement ($\times10^{-4}$) and Young's modulus (GPa) in the case where the amount of Mn is controlled to, or not controlled to, as small as 0.05 to 0.65%. When comparing the line a obtained by linking the values of dynamic Young's modulus-logarithmic decrement of Examples 6 to 10 in which the amount of Mn is limited, with the line b obtained by linking the values of dynamic Young's modulus-logarithmic decrement of Comparative Examples 12 to 16 in which the amount of Mn is as large as 0.65% or more, it is found that the former line a exists at a higher position. In the case of Examples 6 to 10 in which the amount of Mn is limited to a small level, each of these examples shows a logarithmic decrement higher by 30 points than the case where the amount of Mn is larger provided that Young's modulus is the same. This point difference corresponds to a difference of about 10%.

This invention is not limited to the above embodiments as they stand and may be modified by varying the composition of Al, Sn, C, Si, Mn, P, S and the like without departing from the spirit of the invention in a practical stage. Also, various inventions may be made by proper combinations of plural compositions disclosed in the above embodiments.

What is claimed is:

1. A highly stiff and highly damping cast iron consisting of C and Si in an amount of 3.30 to 3.95% in terms of carbon equivalent shown in the following equation (1), Mn in an amount of 0.25 to 1.0%, P in an amount of 0.04% or less, S in an amount of 0.03% or less, Al in an amount of 3 to 7%, and Sn in an amount of 0.03 to 0.20%, and a balance being Fe and unavoidable impurities;

$$\text{Carbon equivalent (\%)} = C(\%) + (1/3) \times Si(\%) \quad (1),$$

wherein the ratio (C/Si) by weight of C to Si is 1.3 to 1.9.

2. A highly stiff and highly damping cast iron consisting of C and Si in an amount of 3.30 to 3.95% in terms of carbon equivalent shown in the following equation (2), Mn in an amount of 0.05 to 0.65%, P in an amount of 0.04% or less, S in an amount of 0.03% or less, Al in an amount of 3 to 7%, and Sn in an amount of 0.03 to 0.20%, and a balance being Fe and unavoidable impurities;

$$\text{Carbon equivalent (\%)} = C(\%) + (1/3) \times Si(\%) \quad (2),$$

wherein the ratio (C/Si) by weight of C to Si is 1.3 to 1.9.

* * * * *